US007520034B2

(12) United States Patent
Sugita

(10) Patent No.: US 7,520,034 B2
(45) Date of Patent: Apr. 21, 2009

(54) SEAT BELT DEVICE

(75) Inventor: Kei Sugita, Settsu (JP)

(73) Assignee: Ashimori Industry Co., Ltd., Osaka-shi (JP)

( * ) Notice: Subject to any disclaimer, the term of this patent is extended or adjusted under 35 U.S.C. 154(b) by 407 days.

(21) Appl. No.: 10/591,792

(22) PCT Filed: Dec. 6, 2004

(86) PCT No.: PCT/JP2004/018149

§ 371 (c)(1),
(2), (4) Date: Sep. 6, 2006

(87) PCT Pub. No.: WO2005/085018

PCT Pub. Date: Sep. 15, 2005

(65) Prior Publication Data

US 2007/0193008 A1 Aug. 23, 2007

(30) Foreign Application Priority Data

Mar. 9, 2004 (JP) ..... 2004-065709

(51) Int. Cl.
*A44B 11/00* (2006.01)

(52) U.S. Cl. ..... 24/633; 24/644; 297/468

(58) Field of Classification Search ..... None
See application file for complete search history.

(56) References Cited

U.S. PATENT DOCUMENTS 4,885,825 A 12/1989 Kitazawa et al.
5,014,401 A 5/1991 Kitazawa
6,328,386 B1 12/2001 Good

FOREIGN PATENT DOCUMENTS

| | | |
|---|---|---|
| EP | 1 077 037 A2 | 2/2001 |
| JP | 63 35609 | 9/1988 |
| JP | 2 23481 | 6/1990 |
| JP | 2 29005 | 8/1990 |
| JP | 3 20215 | 4/1991 |
| JP | 5-40728 | 6/1993 |
| JP | 11 105668 | 4/1999 |
| JP | 2002 293214 | 10/2002 |

*Primary Examiner*—Jack W. Lavinder
(74) *Attorney, Agent, or Firm*—Oblon, Spivak, McClelland, Maier & Neustadt, P.C.

(57) ABSTRACT

A seat belt system capable of reliably preventing inadvertent engagement even on occurrence of erroneous insertion of a tongue plate. The seat belt system includes first and second buckle units respectively including tongue plates and buckle bodies. The buckle bodies respectively include: frames; ejectors; hook members making engagement with engagement holes formed at the tongue plates; and release buttons. A distance from an insertion front end to the engagement hole of the first tongue plate is longer than a corresponding distance at the second tongue plate. A distance from an abutment part to a pushing part of the ejector of the first buckle body is shorter than a corresponding distance of the ejector of the second buckle body. The ejector of the first buckle body includes suppression-specific projections for preventing pivotal movement of the hook member in a direction for making engagement.

4 Claims, 8 Drawing Sheets

SEAT BELT DEVICE

TECHNICAL FIELD

The present invention is applied to a seat belt system for protecting an occupant. More specifically, the present invention relates to the improvement of a seat belt system with a plurality of buckle units.

BACKGROUND ART

A conventional seat belt system is so constructed that a tongue plate attached to webbing is engaged with a corresponding buckle body paired with the tongue plate. This binds an occupant to a seat to absorb an impact at the time of a crash and the like, thereby protecting the occupant.

A plurality of seat belt systems are placed at a rear seat of a vehicle to bind more than two occupants to their respective seats. In order to prevent one occupant from mistakenly wearing a seat belt system for a neighboring occupant, a structure for preventing incorrect wearing has been adopted where appropriate (see patent publication 1, for example).

The structure of a seat belt system disclosed in patent publication 1 comprises a plurality of buckle units each being formed by a tongue plate and a buckle body into which the tongue plate is inserted. The buckle body has an ejector caused to move within the buckle body by the insertion of the tongue plate, and a hook member caused to pivot by being pushed by the movement of the ejector to thereby come into engagement with an engagement hole of the tongue plate.

The seat belt system of patent publication 1 comprises: a first buckle unit featuring a short distance from an insertion front end to an engagement hole of a tongue plate while allowing an ejector to move a long distance; and a second buckle unit featuring a long distance from an insertion front end to an engagement hole of a tongue plate while allowing an ejector to move a short distance.

When a tongue plate having a short distance from an insertion front end to an engagement hole is inserted into the second buckle unit allowing an ejector to move a short distance, the ejector moves a small amount. Thus a hook member is not pushed by the ejector and the hook member is not caused to pivot in a direction in which the hook member makes engagement with the engagement hole, thereby preventing inadvertent engagement.

When a tongue plate having a long distance from an insertion front end to an engagement hole is inserted into the first buckle unit allowing an ejector to move a long distance, the ejector reaches a position for pushing a hook member. Thus the hook member is pushed by the ejector and is then caused to pivot in a direction in which the hook member makes engagement. However, the engagement hole of the tongue plate has not reached a position for making engagement with the hook member, thereby preventing inadvertent engagement.

Patent Publication 1: Japanese Utility Model Publication No. 5-40728 (1993)

According to the conventional seat belt system described above, the engagement hole of the tongue plate has not reached a position for making engagement with the hook member when the tongue plate having a long distance from the insertion front end to the engagement hole is inserted into the first buckle unit allowing the ejector to move a long distance. This reliably prevents inadvertent engagement. However, the engagement hole of the tongue plate has reached a position for making engagement with the hook member when the tongue plate having a short distance from the insertion front end to the engagement hole is inserted into the second buckle unit allowing the ejector to move a short distance. This may disadvantageously cause the hook member to pivot in a direction in which the hook member makes engagement by the vibration, oscillation or the like of the buckle unit itself.

DISCLOSURE OF THE INVENTION

The present invention is intended to provide a seat belt system capable of reliably preventing inadvertent engagement even on the occurrence of erroneous insertion of a tongue plate.

In one aspect of a seat belt system according to the present invention, the seat belt system is equipped with a first buckle unit comprising a first tongue plate and a first buckle body, and a second buckle unit comprising a second tongue plate and a second buckle body. The buckle bodies respectively include: frames; ejectors slidably mounted on the frames in a direction in which the tongue plates are inserted, while being biased in a direction in which the tongue plates are released; hook members pivotally mounted on the frames, the hook members pivoting when the tongue plates are inserted to make engagement with engagement holes formed at the tongue plates; and release buttons for breaking engagement between the hook members and the tongue plates. A distance from an insertion front end to the engagement hole of the first tongue plate is longer than a distance from an insertion front end to the engagement hole of the second tongue plate. The ejectors respectively include abutment parts pushed by the tongue plates when the tongue plates are inserted. The ejectors further respectively include pushing parts being in contact with the hook members when the tongue plates are most deeply inserted to force the hook members to pivot in a direction for making engagement with the tongue plates. A distance from the abutment part to the pushing part of the ejector of the first buckle body is shorter than a distance from the abutment part to the pushing part of the ejector of the second buckle body. The seat belt system comprises restriction means for preventing the ejector of the first buckle body from reaching a position for making engagement when the second tongue plate is inserted into the first buckle body. The ejector of the first buckle body has suppression-specific projections for preventing the pivotal movement of the hook member in a direction for making engagement until the ejector reaches a position for making engagement between the first tongue plate and the hook member.

According to this aspect, when the first tongue plate is inserted into the second buckle body, the distance from the insertion front end to the engagement hole of the first tongue plate is longer than the corresponding distance at the second tongue plate. Further, the distance between the abutment part and the pushing part of the ejector is long. Thus, even when the first tongue plate is most deeply inserted and the ejector pushes the hook member to thereby force the hook member to pivot in a direction for making engagement, the engagement hole of the first tongue plate does not reach a position for making engagement with the hook member. As a result, no engagement is made therebetween.

On the other hand, when the second tongue plate is inserted into the first buckle body, the distance from the insertion front end to the engagement hole of the second tongue plate is shorter than the corresponding distance at the first tongue plate. Further, the distance between the abutment part and the pushing part of the ejector is short. Thus, even when the engagement hole of the second tongue plate reaches a position for making engagement with the hook member, the restriction means serves to prevent the ejector from reaching a position for forcing the hook member to pivot. That is, even when the engagement hole of the second tongue plate reaches a position for making engagement with the hook member, the ejector does not reach a correct position for making forced pivotal movement of the hook member. Suppression-specific projections formed at the ejector serve to prevent the pivotal movement of the hook member in a direction for making engagement. As a result, inadvertent engagement can be avoided even when vibration, oscillation or the like is generated.

This reliably prevent inadvertent engagement even on the occurrence of erroneous insertion of the tongue plates.

In another aspect of the seat belt system according to the present invention, the buckle bodies respectively have lower covers with openings through which the tongue plates are inserted, and upper covers coupled to the lower covers. A projection is defined at the opening of the lower cover of the first buckle body, the projection projecting further in a direction for releasing the tongue plate than that at the opening of the lower cover of the second buckle body, thereby constituting the restriction means.

According to this aspect, when the second tongue plate is inserted into the first buckle body, the projection as the restriction means formed at the opening of the lower cover of the first buckle body is operative to restrict the amount of insertion of the second tongue plate. The movement of the ejector is more effectively limited accordingly to prevent the ejector from reaching a position for making engagement between the first tongue plate and the hook member. As a result, the forced pivotal movement of the hook member can be more reliably avoided to thereby more securely prevent the inadvertent engagement of the hook member.

In still another aspect of the seat belt system according to the present invention, a distance from an insertion front end to an insertion terminal end of an insertion part of the first tongue plate to be inserted into the first buckle body is longer than a distance from an insertion front end to an insertion terminal end of an insertion part of the second tongue plate to be inserted into the second buckle body, thereby constituting the restriction means.

According to this aspect, when the second tongue plate is inserted into the first buckle body, the second tongue plate is inserted less than the first tongue plate. Thus, the movement of the ejector can be more restricted. Like the effect mentioned above, this also more reliably avoids the forced pivotal movement of the hook member to thereby more securely prevent the inadvertent engagement of the hook member.

BEST MODE FOR CARRYING OUT THE INVENTION

Figure 1:
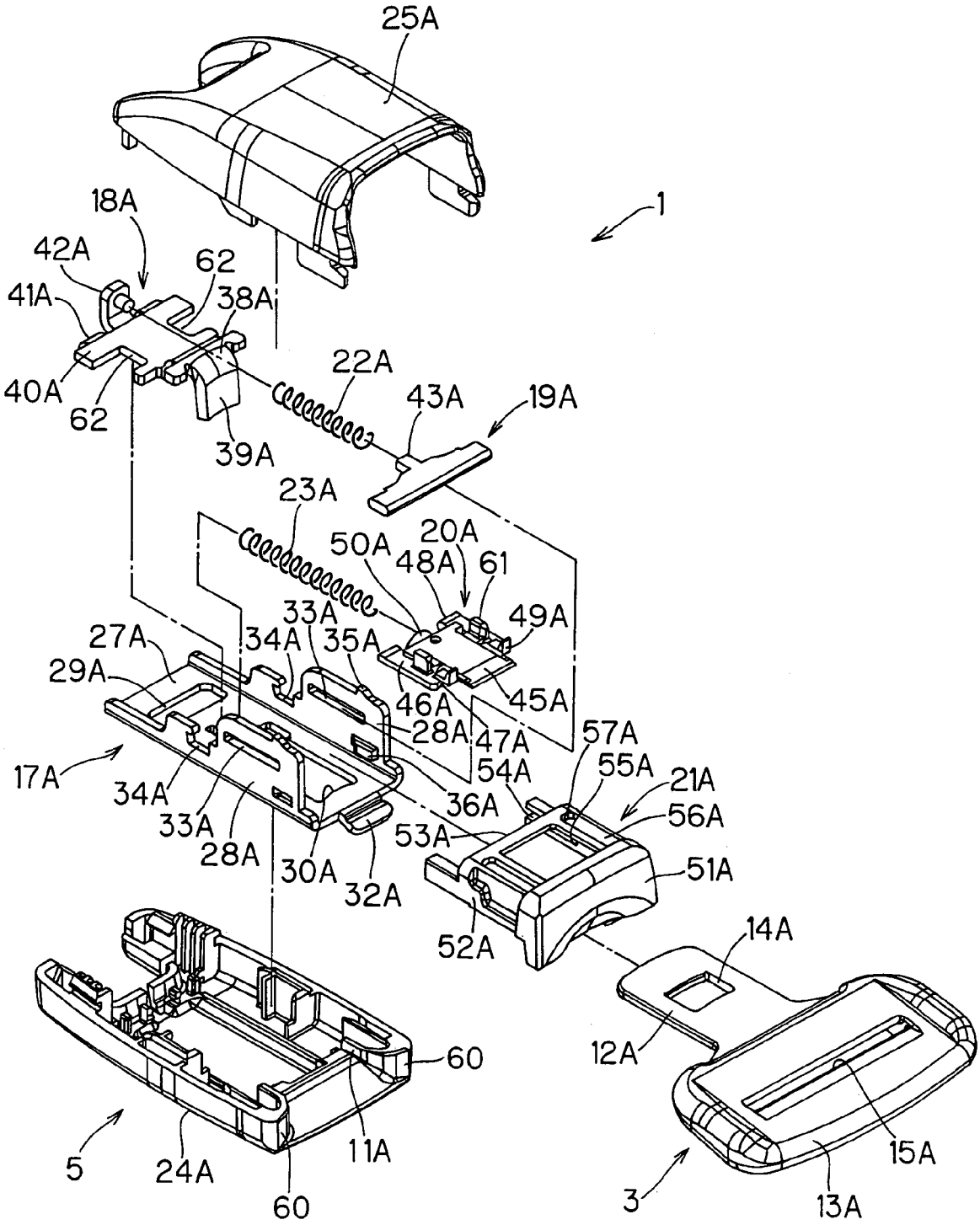
FIG. 1 is an exploded perspective view showing a first buckle unit according to an embodiment of the present invention.
Figure 2:
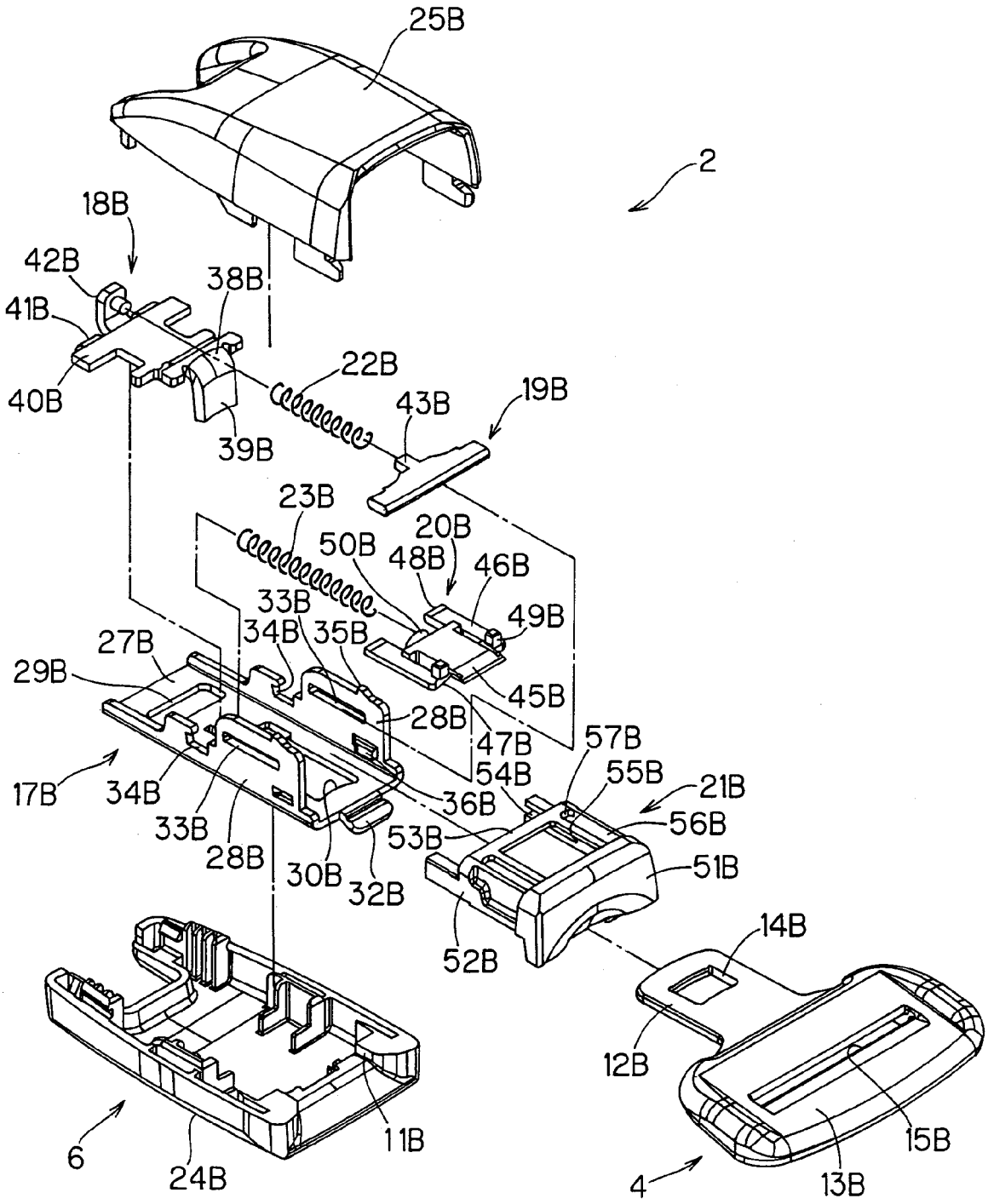
FIG. 2 is an exploded perspective view showing a second buckle unit according to the embodiment of the present invention.
Figure 3:
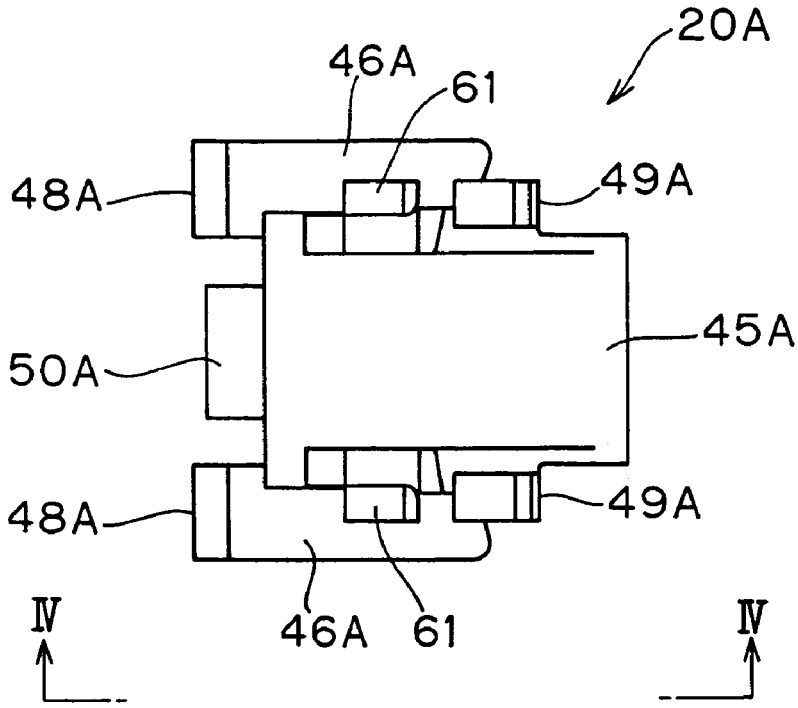
FIG. 3 is a plan view of an ejector of the first buckle unit.
Figure 4:
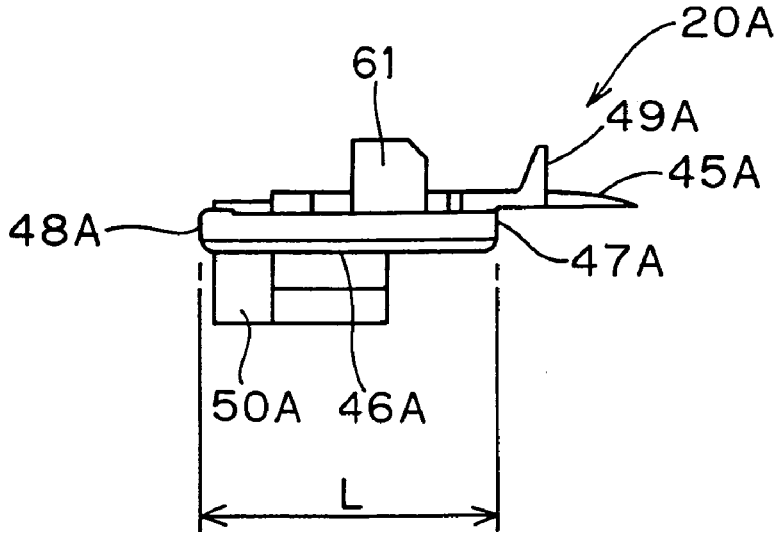
FIG. 4 is a view on arrow taken along line IV-IV of FIG. 3.
Figure 5:
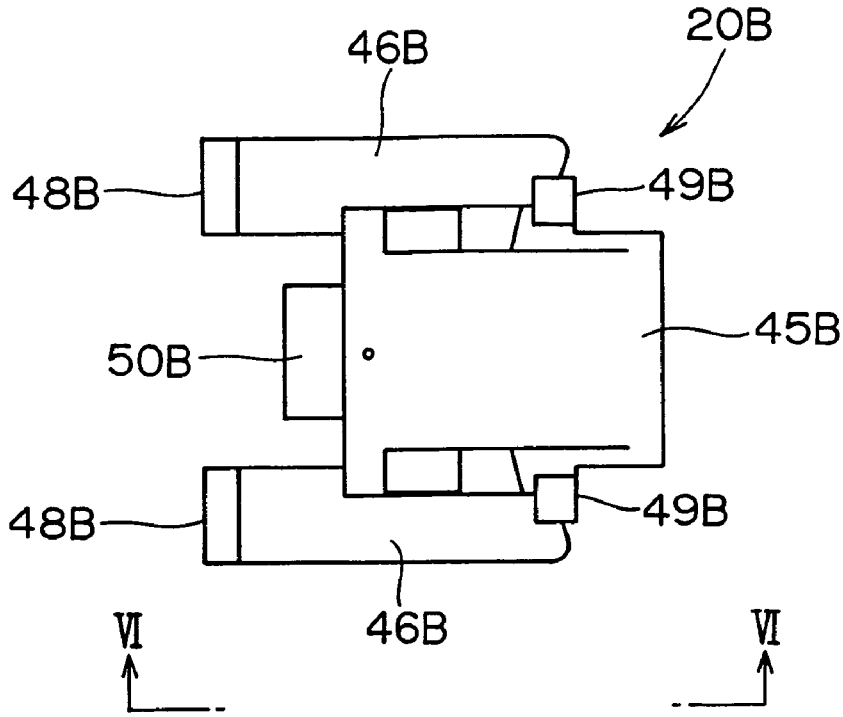
FIG. 5 is a plan view of an ejector of the second buckle unit.
Figure 6:
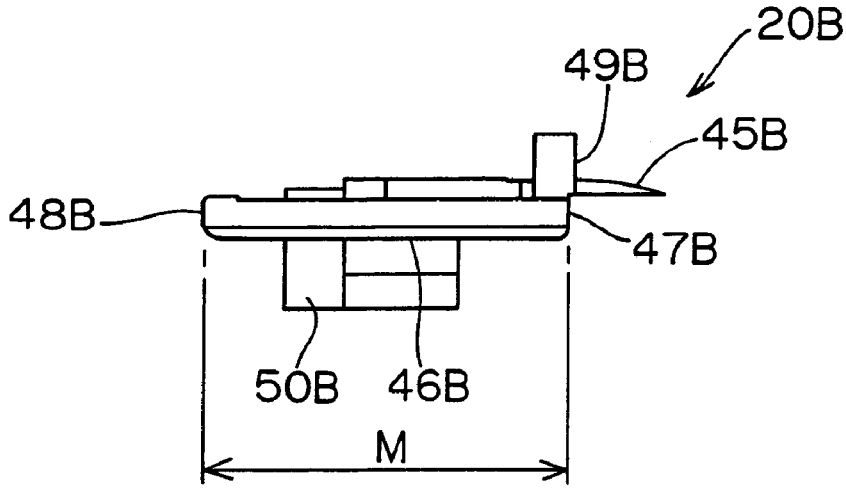
FIG. 6 is a view on arrow taken along line VI-VI of FIG. 5.
Figure 7:
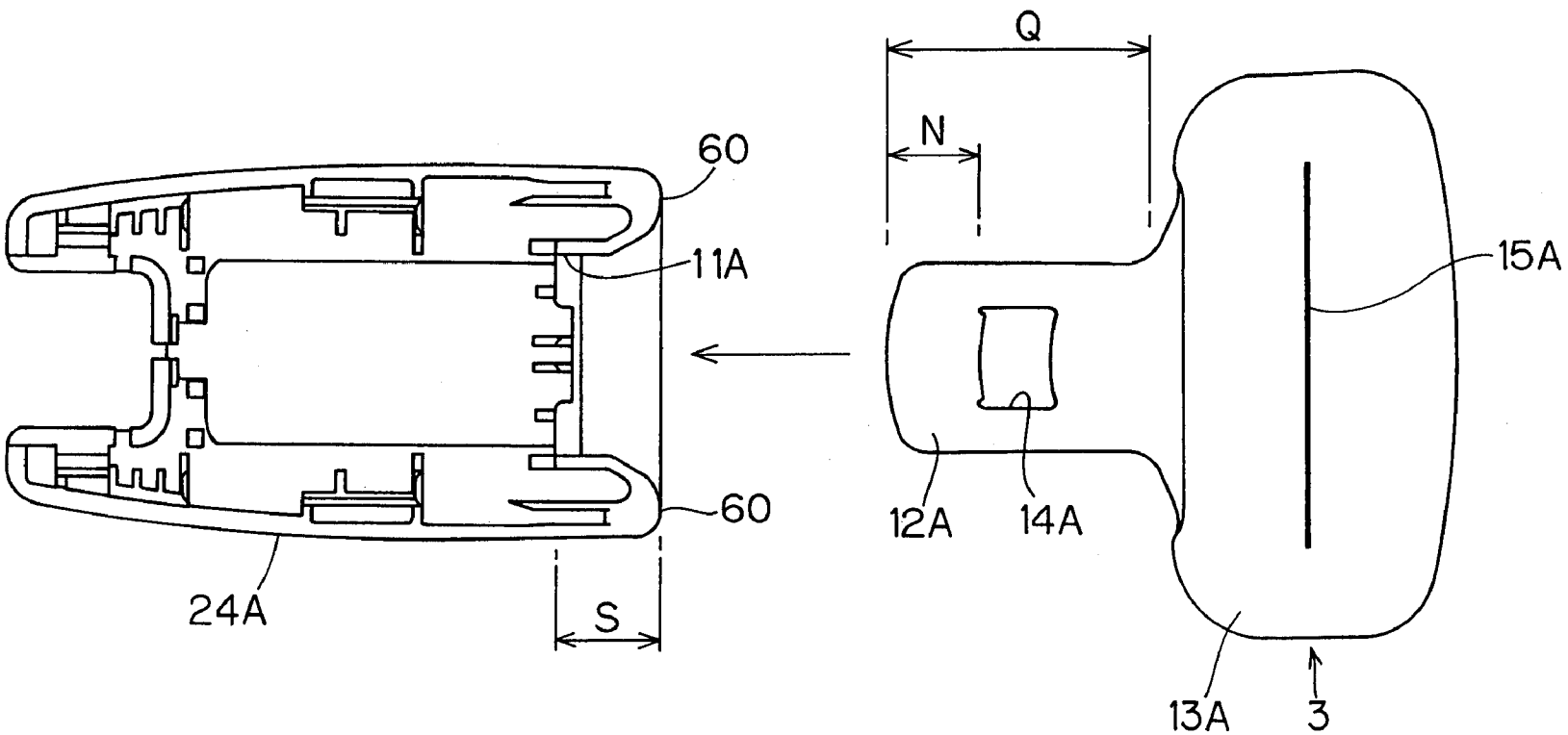
FIG. 7 is an explanatory plan view of a first tongue plate and a lower cover of the first buckle unit.
Figure 8:
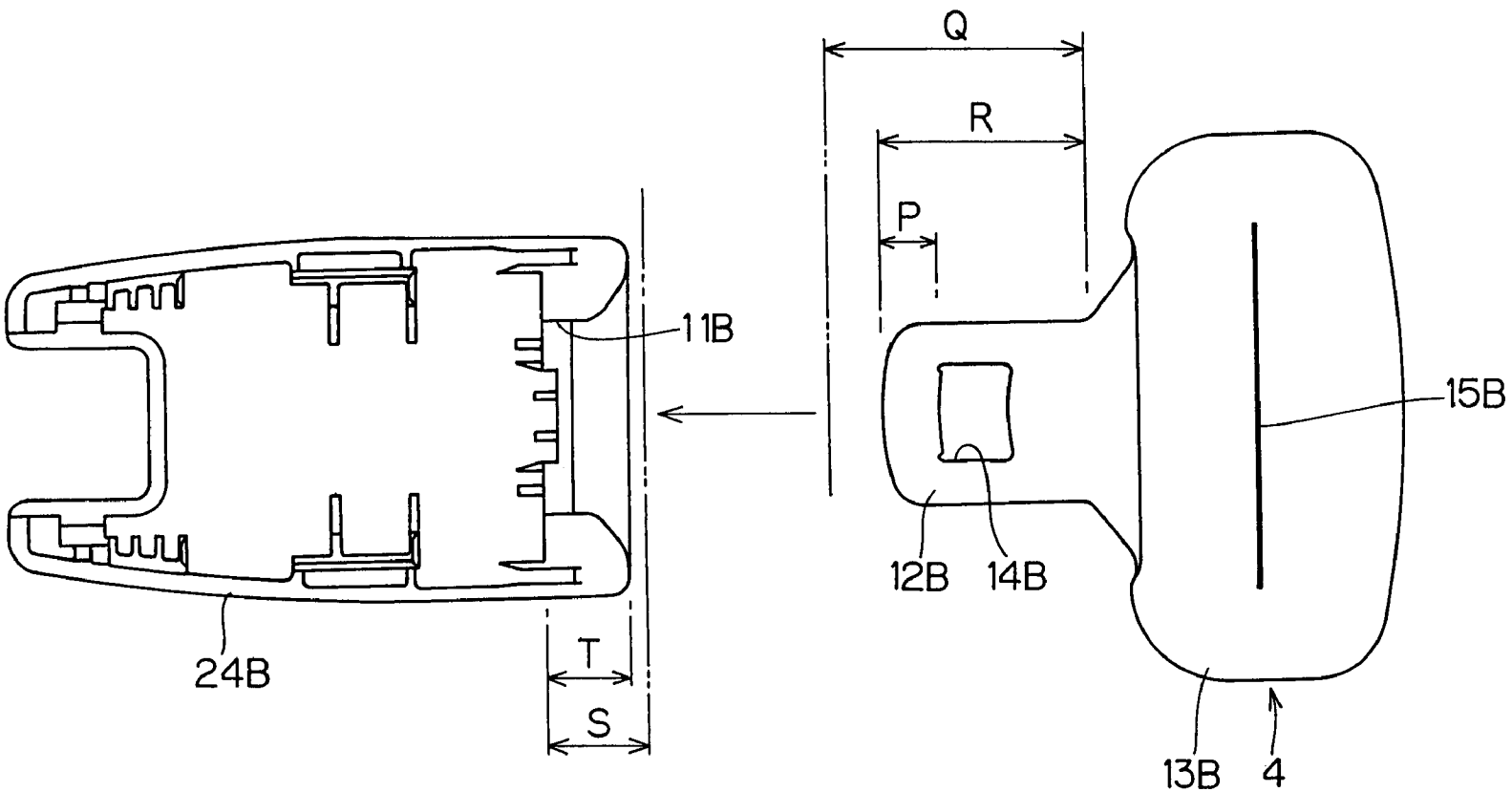
FIG. 8 is an explanatory plan view of a second tongue plate and a lower cover of the second buckle unit.

Next, an embodiment of the present invention will be described with reference to drawings. FIGS. 1 through 12 show a seat belt system placed for example at a rear seat of a vehicle. This seat belt system is formed by two types of buckle units including: a first buckle unit 1 for a rear center seat prepared for an occupant to be seated in the middle; and a pair of second buckle units 2 for rear side seats prepared for occupants to be seated on the left and right sides.

The first buckle units 1 and each of the second buckle units 2 respectively comprise a first tongue plate 3 and a second tongue plate 4 movably attached at an intermediate locations on webbing (not shown), and a first buckle body 5 and a second buckle body 6. Tongue inlets 11A and 11B of the same width serving as openings for receiving the tongue plates 3 and 4 are respectively provided at front ends as one of end portions of the buckle bodies 5 and 6.

The tongue plates 3 and 4 respectively have metallic tongue parts 12A and 12B serving as insertion parts to be received by the corresponding buckle bodies 5 and 6, and tongue bodies 13A and 13B covered by a synthetic resin material and integrally molded with the tongue parts 12A and 12B. Substantially rectangular engagement holes 14A and 14B are respectively formed at the tongue parts 12A and 12B. Webbing receiving slots 15A and 15B are respectively formed at the tongue bodies 13A and 13B.

The buckle bodies 5 and 6 respectively have: frames 17A and 17B; hook members 18A and 18B; lock bars 19A and 19B; ejectors 20A and 20B; release buttons 21A and 21B made of synthetic resin; coil springs 22A, 23A and 22B, 23B for applying elastic forces; lower covers 24A and 24B made of synthetic resin; upper covers 25A and 25B respectively coupled to the lower covers 24A and 24B, and the like. The members other than those made of synthetic resin are made of metal (such as steel).

The frames 17A and 17B respectively have base plates 27A and 27B, and pairs of side plates 28A and 28B integrally molded with the base plates 27A and 28B while standing upright from the left and right edges of the base plates 27A and 28B, respectively. The base plates 27A and 27B are respectively provided with: webbing coupling holes 29A and 29B each allowing one end of webbing fixed to the vehicle to be fixedly coupled thereto; substantially rectangular guide holes 30A and 30B for storing the coil springs 23A and 23B in compression that push the ejectors 20A and 20B forward by elastic forces while guiding the movements of the ejectors 20A and 20B; spring receivers 31A and 31B (see FIGS. 9 through 12) projecting forward from the rear edges of the guide holes 30A and 30B; and slanting parts 32A and 32B engaged with the lower covers 24A and 24B.

The pairs of side plates 28A and 28B are respectively provided with: a pair of long holes 33A and 33B for receiving respective end portions of the lock bars 19A and 19B to slidably guide the lock bars 19A and 19B back and forth; notches 34A and 34B on which the hook members 18A and 18B are pivotally mounted; a pair of stoppers 35A and 35B to which the release buttons 21A and 211B are anchored to prevent the disengagement of the release buttons 21A and 211B in a forward direction; and a pair of guide projections 36A and 36B projecting inwardly for guiding the engagement and disengagement of the tongue plates 3 and 4 while allowing the tongue plates 3 and 4 to be inserted with no complication.

With reference to FIGS. 1, 2, and 9 through 12, the hook members 18A and 18B respectively have: restriction parts 38A and 38B swelling upward in the form of a curve from the fronts of the respective bodies; hook parts 39A and 39B bending downward from the restriction parts 38A and 38B and capable of being engaged with the engagement holes 14A and 14B of the tongue parts 12A and 12B, while having tip portions capable of being engaged in the front ends of the guide holes 30A and 30B of the base plates 27A and 27B; pairs of left and right pivotally mounted parts 40A and 40B that project leftward and rightward at the rear sides; pairs of left and right to-be-operated parts 41A and 41B bending downward from the rear ends of the bodies while being brought into operation by the ejectors 20A and 20B; and spring receivers 42A and 42B bending upward between the pairs of to-be-operated parts 41A and 41B. The pairs of left and right pivotally mounted parts 40A and 40B are pivotally mounted on the notches 34A and 34B of the pairs of side plates 28A and 28B respectively, whereby the hook members 18A and 18B are allowed to pivot up and down to a predetermined angle.

The lock bars 19A and 19B will be discussed next. With reference to FIGS. 1, 2, and 9 through 12, the lock bars 19A and 19B are each formed by a strip-shaped member. The lock bars 19A and 19B are respectively inserted into the pairs of long holes 33A and 33B on the left and right sides to be attached to the pairs of side plates 28A and 28B. In this condition, left and right end portions of the lock bars 19A and 19B project outward from the side plates 28A and 28B by about 2 to 3 mm, and the lock bars 19A and 19B are capable of moving back and forth a certain distance along the pairs of long holes 33A and 33B.

The lock bars 19A and 19B are respectively provided with spring receivers 43A and 43B in the form of projections at the centers of the rear edges. The coil springs 22A and 22B (serving as members for applying elastic forces) are respectively interposed in compression between the spring receivers 42A, 42B of the hook members 18A, 18B and the spring receivers 43A, 43B of the lock bars 19A, 19B. Then the lock bars 19A and 19B are always forward biased, whereas the hook parts 39A and 39B of the hook members 18A and 18B are always biased upward (in a direction in which the hook members 18A and 18B go out of engagement with the tongue plates 3 and 4).

When the tongue plates 3 and 4 are inserted into the corresponding buckle bodies 5 and 6 to bring the tongue plates 3 and 4 into engagement with the hook members 18A and 18B, respectively, the lock bars 19A and 19B are located at a first position at the front ends of the pairs of long holes 33A and 33B to hold the restriction parts 38A and 38B. Then the hook members 18A and 18B are prevented from pivoting in a direction in which the hook members 18A and 18B break engagement. When the release buttons 21A and 21B become operative to break engagement, the lock bars 19A and 19B are pushed backward by the release buttons 21A and 21B. Then the lock bars 19A and 19B are retracted to a second position at the rear ends of the pairs of long holes 33A and 33B that are behind the restriction parts 38A and 38B, thereby allowing the hook members 18A and 18B to pivot in a direction for breaking engagement.

The ejectors 20A and 20B will be discussed next. With reference to FIGS. 1 through 6 and 9 through 12, the ejectors 20A and 20B respectively have: slanting guide parts 45A and 45B provided at their front ends; guided parts 46A and 46B provided at the left and right edges; abutment parts 47A and 47B pushed by the tongue plates 3 and 4 when the tongue plates 3 and 4 are inserted; pairs of pushing parts 48A and 48B for causing the pairs of left and right to-be-operated parts 41A and 41B of the hook members 18A and 18B to pivot backward when the tongue plates 3 and 4 are inserted to thereby force the hook members 18A and 18B to pivot in a direction for making engagement; pairs of left and right pushing back parts 49A and 49B for pushing the release buttons 21A and 21B forward when the engagement with the tongue plates 3 and 4 is to be broken; and spring receivers 50A and 50B to which the front ends of the coil springs 23A and 23B are coupled.

The arrangement of the ejectors 20A and 20B is such that the ejectors 20A and 20B are allowed to freely move back and forth on the base plates 27A and 27B of the frames 17A and 17B. The pairs of guided parts 46A and 46B are slidably engaged with both side edges of the guide holes 30A and 30B, whereby the ejectors 20A and 20B are guided without floating.

The coil springs 23A and 23B each have one end coupled to the spring receivers 50A and 50B, and the other end coupled to the spring receivers 31A and 31B of the base plates 27A and 27B. Then the ejectors 20A and 20B are forward biased with respect to the frames 17A and 17B (namely, in a direction in which the tongue plates 3 and 4 go out of engagement) by the elastic forces of the coil springs 23A and 23B arranged in compression.

The release buttons 21A and 21B will be discussed next. With reference to FIGS. 1, 2, and 9 through 12, the release buttons 21A and 21B respectively have: front walls 51A and 51B provided at their front ends; pairs of left and right guide walls 52A and 52B; and top walls 53A and 53B provided at their top ends. The pairs of guide walls 52A and 52B are respectively arranged outside the pairs of side plates 28A and 28B of the frames 17A and 17B in proximity thereto. The pairs of guide walls 52A and 52B are respectively provided with pairs of guide slots 54A and 54B that respectively border the pairs of long holes 33A and 33B from the outside. The guide slots 54A and 54B have a slender shape in a transverse direction so that both end portions of each of the lock bars 19A and 19B can be movably guided back and forth.

When the release buttons 21A and 211B are located at their limit positions of forward movement (positions shown in FIGS. 9 through 12), the respective front ends of the guide slots 54A and 54B are located at positions slightly behind the positions of the front ends of the long holes 33A and 33B. Further, the guide walls 52A and 52B are respectively provided with receivers 55A and 55B arranged at the front ends of the guide slots 54A and 54B. The pairs of receivers 55A and 55B serve to receive the respective ends of the lock bars 19A and 19B that have moved from the second position to the first position, the respective ends of the lock bars 19A and 19B projecting leftward and rightward from the long holes 33A and 33B. These pairs of receivers 55A and 55B respectively provided at the pairs of guide walls 52A and 52B and integrally formed with the release buttons 21A and 21B are operative to function as stop control parts. When the lock bars 19A and 19B are moved by the elastic forces of the coil springs 22A and 22B to the first position, the stop control parts serve to receive the lock bars 19A and 19B in opposition to these elastic forces.

The top walls 53A and 53B of the release buttons 21A and 21B are respectively provided with pairs of left and right slits 56A and 56B that allow the release buttons 21A and 21B to move back and forth relative to the pairs of stoppers 35A and 35B formed at the pairs of side plates 28A and 28B of the frames 17A and 17B. When the tongue plates 3 and 4 are inserted, the lock bars 19A and 19B are moved by the elastic forces of the coil springs 22A and 22B from the second position to the first position to be received by the pairs of receivers 55A ands 55B. At this time, pairs of anchored parts 57A and 57B formed at the rear ends of the pairs of slits 56A and 56B are respectively anchored by the pairs of stoppers 35A and 35B, thereby causing the release buttons 21A and 21B to stop at their limit positions of forward movement.

The inner surfaces of the front walls 51A and 51B of the release buttons 21A and 21B are respectively provided with pairs of pushed back parts 58A and 58B that are in contact with the pairs of pushing back parts 49A and 49B of the ejectors 20A and 20B to be pushed forward thereby, when the tongue plates 3 and 4 are to be released from the buckle bodies 5 and 6. When the tongue plates 3 and 4 are released from the buckle bodies 5 and 6, the ejectors 20A and 20B biased by the elastic forces of the coil springs 23A and 23B cause the release buttons 21A and 21B to push forward together with the tongue plates 3 and 4 (in a direction in which the tongue plate 3 and 4 are released). Then the release buttons 21A and 21B return to their limit positions of forward movement and the ejectors 20A and 20B stop. At this time, the ejectors 20A and 20B stop their movements so that slight clearances are maintained between the front ends of the guide holes 30A and 30B defined at the frames 17A and 17B and the ejectors 20A and 20B, whereby the release buttons 21A and 21B are still allowed to move forward upon receipt of the elastic forces of the coil springs 23A and 23B.

The hook members 18A, 18B, lock bars 19A, 19B, ejectors 20A, 20B, release buttons 21A, 21B, coil springs 22A, 22B, 23A, 23B, and the like are mounted on the frames 17A and 17B. The frames 17A and 18B with these members mounted thereon are assembled into the lower covers 24A, 24B and the upper covers 25A, 25B. Then the lower covers 24A, 24B and the upper covers 25A, 25B are fixedly coupled via a plurality of fitting parts and engagement parts and are integrated. The release buttons 21A and 21B are so arranged that their front ends border the front ends of the buckle units 1 and 2 thereby assembled. The release buttons 21A and 21B can be brought into operation by pressing the front ends of the release buttons 21A and 21B by a finger.

In this embodiment, as shown in FIGS. 3 through 8, a distance L between the abutment part 47A and the pushing part 48A of the ejector 20A at the first buckle body 5 is set shorter than a distance M between the abutment part 47B and the pushing part 48B of the ejector 20B at the second buckle body 6.

A distance N from the insertion front end to the engagement hole 14A at the tongue part 12A of the first tongue plate 3 is set longer than a distance P from the insertion front end to the engagement hole 14B at the tongue part 12B of the second tongue plate 4. Further, a distance Q from the insertion front end to the insertion terminal end of the tongue part 12A to be inserted into the first buckle unit 5 is also set longer than a distance R from the insertion front end to the insertion terminal end of the tongue part 12B to be inserted into the second buckle body 6.

The tongue inlets 11A and 11B at the lower covers 24A and 24B respectively have tapered fronts that are broadened toward the front so that the tongue parts 12A and 12B of the tongue plates 3 and 4 are guided into the tongue inlets 11A and 11B along the centers thereof. The taper angle at the lower cover 24A of the first buckle body 5 is smaller than the taper angle at the lower cover 24B of the second buckle body 6. Thus a distance S in a direction for releasing the tongue plate 3 defined at the tongue inlet 11A of the lower cover 24A is made longer than a distance T in a direction for releasing the tongue plate 4 defined at the tongue inlet 11B of the lower cover 24B. This difference in distance (S−T) forms a so-called projection 60 at the front end of the tongue inlet 11A of the lower cover 24A that projects in a direction for releasing the tongue plate 3.

The ejector 20A of the first buckle body 5 is provided with a pair of suppression-specific projections 61 projecting upward from both sides of the ejector 20A. Interference prevention parts 62 in the form of notches for preventing the interference with the corresponding suppression-specific projections 61 are formed at both sides of the hook member 18A and in front of the pivotally mounted parts 40A. When the ejector 20A is pushed in by the insertion of the first tongue plate 3, the suppression-specific projections 61 of the ejector 20A interfere with the lower surface of the hook member 18A to prevent the pivotal movement of the hook member 18A in a direction for making engagement until the ejector 20A reaches a position for making engagement between the engagement hole 14A of the first tongue plate 3 and the hook part 39A of the hook member 18A.

The shapes of the upper covers 25A and 25B are in conformity with the shapes of the corresponding lower covers 24A and 24B. The other members of the first and second buckle units 1 and 2, namely, the frames 17A and 17B, hook members 18A and 18B, lock bars 19A and 19B, release buttons 21A and 21B, and coil springs 22A, 22B, 23A and 23B respectively have the same shapes. This allows the first and second buckle units 1 and 2 to share members.

Next, the operations of the above-discussed buckle units 1 and 2 will be described.

Figure 9:
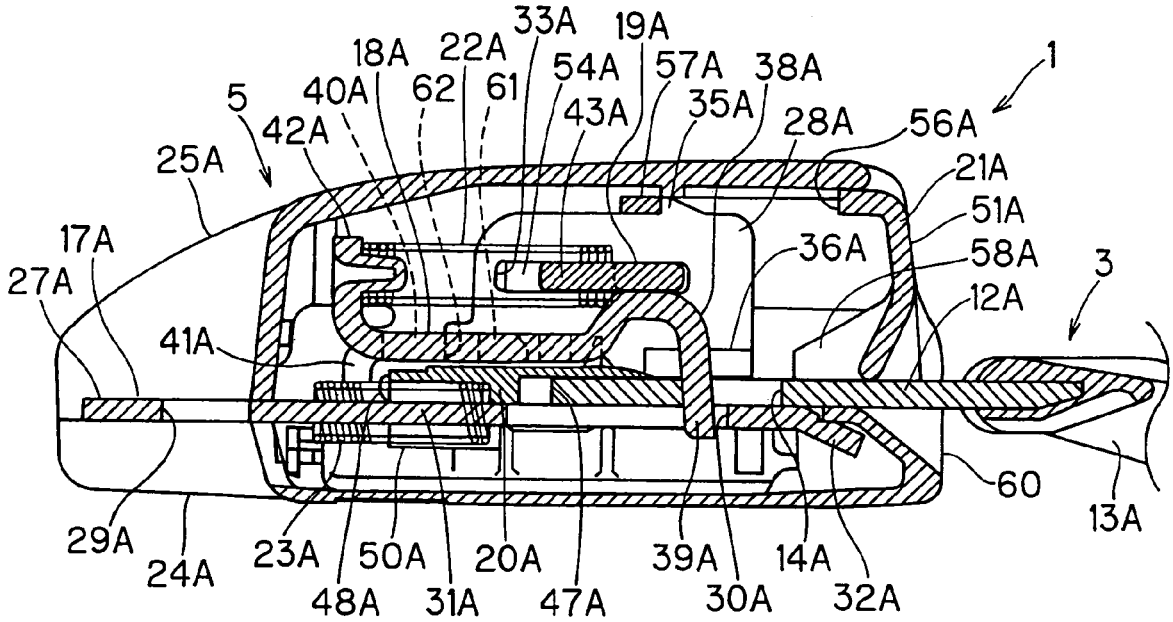
FIG. 9 is a sectional view showing how the first tongue plate and a first buckle body are engaged.
Figure 10:
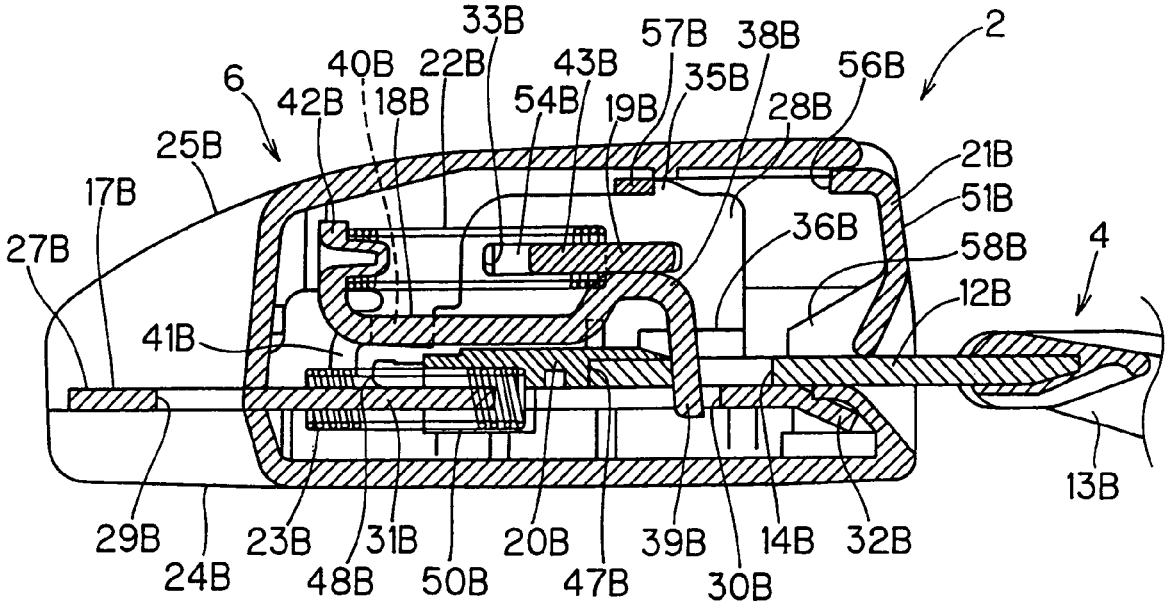
FIG. 10 is a sectional view showing how the second tongue plate and a second buckle body are engaged.

First, it will be discussed how the first tongue plate 3 and the second tongue plate 4 are inserted and coupled into the corresponding first buckle body 5 and the corresponding second buckle body 6, respectively. The tongue parts 12A and 12B of the tongue plates 3 and 4 are respectively inserted through the tongue inlets 11A and 11B to be in contact with the abutment parts 47A and 47B of the ejectors 20A and 20B. The tongue plates 3 and 4 are further inserted in opposition to the elastic forces of the coil springs 23A and 23B to push the ejectors 20A and 20B backward. This causes the pairs of pushing parts 48A and 48B at rear ends of the ejectors 20A and 20B to be in contact with the pairs of to-be-operated parts 41A and 41B of the hook members 18A and 18B to thereby cause the hook members 18A and 18B to pivot backward about the pivotally mounted parts 40A and 40B. Then as shown in FIGS. 9 and 10, the hook members 18A and 18B are forced to pivot in a direction for making engagement in opposition to the elastic forces of the coil springs 22A and 22*b* to be engaged with the engagement holes 14A and 14B of the tongue parts 12A and 12B. Further, the lock bars 19A and 19B move forward from the second position at the rear ends to the first position at the first ends of the long holes 33A and 33B, respectively.

At this time, in the first buckle body 5, the ejector 20A is pushed backward by the insertion of the first tongue plate 3 to cause the suppression-specific projections 61 of the ejector 20A to move to the positions of the interference prevention parts 62 of the hook member 18A. Thus the hook member 18A is forced to pivot in a direction for making engagement without any problem.

When the tongue plates 3 and 4 are respectively engaged with the hook members 18A and 18B, the hook parts 39A and 39B are engaged with the engagement holes 14A and 14B of the tongue parts 12A and 12B and with the guide holes 30A and 30B of the frames 17A and 17B, thereby anchoring the tongue parts 12A and 12B. The lock bars 19A and 19B are in contact with the upper surfaces of the restriction parts 38A and 38B at the first position to restrict the pivotal movement of the hook members 18A and 18B in a direction for breaking engagement. The pairs of anchored parts 57A and 57B of the release buttons 21A and 21B are respectively anchored by the pairs of stoppers 35A and 35B of the side plates 28A and 28B, thereby causing the release buttons 21A and 21B to stop at their limit positions of forward movement.

Under these conditions of engagement, both end portions of the lock bars 19A and 19B are respectively in contact with the pairs of receivers 55A and 55B of the release buttons 21A and 21*b*. Then the release buttons 21A and 21B are forward biased by the lock bars 19A and 19B subjected to the application of the elastic forces of the coil springs 22A and 22B.

Next, it will be discussed how the tongue plates 3 and 4 are released from the buckle bodies 5 and 6. In the conditions of engagement shown in FIGS. 9 and 10, the release buttons 21A and 21B are pressed backward by a finger in opposition to the elastic forces of the coil springs 22A and 22B to push the respective left and right portions of the lock bars 19A and 19B backward from the pairs of left and right receivers 55A and 55B of the release buttons 21A and 21B. Then the lock bars 19A and 19B are moved backward together with the release buttons 21A and 21B to the second position to bring the coil springs 22A and 22B into compression. Using the elastic forces of the coil springs 22A and 22B accumulated by this compression, the hook members 18A and 18B are caused to pivot through the spring receivers 42A and 42B of the hook members 18A and 18B about the pivotally mounted parts 40A and 40B in a direction for breaking engagement.

When the lock bars 19A and 19B reach the second position, the lock bars 19A and 19B are located at positions behind the regulation parts 38A and 38B to be brought out of contact with the regulation parts 38A and 38B. Then the hook members 18A and 18B pivot upward to their maxima to be brought into a condition of breaking engagement in which the tongue plates 3 and 4 are moved forward to be released from the buckle bodies 5 and 6. At this time, the abutment parts 47A and 47B of the ejectors 20A and 20B are in contact with the insertion front ends of the tongue plates 3 and 4. Thus the tongue plates 3 and 4 are forward biased through the ejectors 20A and 20B by means of the accumulated elastic forces of the coil springs 23A and 23B, to be released from the buckle bodies 5 and 6.

The pairs of pushing back parts 49A and 49B of the ejectors 20A and 20B are in contact with the pairs of pushed back parts 58A and 58B of the release buttons 21A and 21B. Thus, when a finger is moved off the release buttons 21A and 21B, the release buttons 21A and 21B are forward biased by the ejectors 20A and 20B subjected to the application of the elastic forces of the coil springs 23A and 23B. As a result, the release buttons 21A and 21B return to their limit positions of forward movement.

Next, the operations of the buckle units 1 and 2 will be discussed when the tongue plates 3 and 4 are mistakenly inserted into the buckle bodies 5 and 6 not corresponding thereto.

Figure 11:
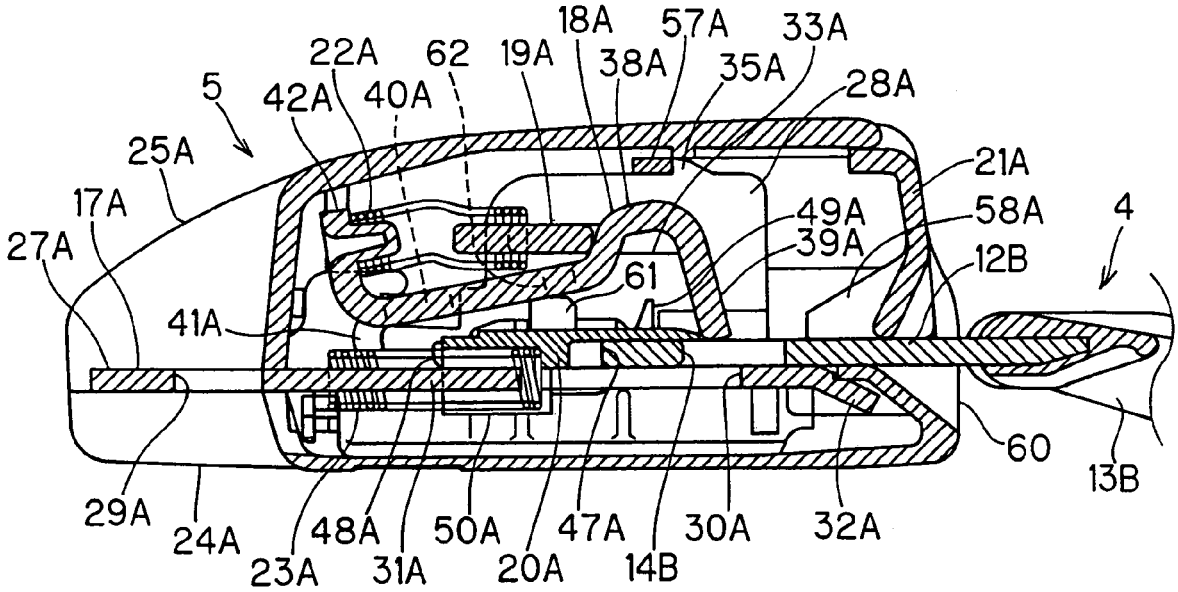
FIG. 11 is a sectional view showing the second tongue plate inserted into the first buckle body.

First, it is assumed that the second tongue plate 4 is mistakenly inserted into the first buckle body 5. As shown in FIG. 11, the distance R from the insertion front end to the insertion terminal end of the tongue part 12B of the second tongue plate 4 is shorter than the corresponding distance Q at the first tongue plate 3. Further, the distance L between the abutment part 47A and the pushing part 48A of the ejector 20A is shorter than the corresponding distance M at the ejector 20B of the second buckle body 6. Thus the ejector 20A does not reach a position for forcing the hook member 18A to pivot. Here, the difference between the distance R at the tongue part 12B of the second tongue plate 4 and the distance Q from the insertion front end to the insertion terminal end of the tongue plate 12A of the first tongue plate 3 constitutes restriction means for preventing the ejector 20A from reaching a position for making engagement, namely, a position for making forced pivotal movement when the second tongue plate 4 is mistakenly inserted.

The distance P from the insertion front end to the engagement hole 14B of the tongue part 12B is shorter than the corresponding distance N at the first tongue plate 3, and hence the hook member 18A is not forced to pivot in a direction for making engagement even when the engagement hole 14B reaches a position for making engagement with the hook part 39A of the hook member 18A. Further, the ejector 20A fails to reach a position for making forced pivotal movement of the hook member 18A. Hence, the suppression-specific projections 61 of the ejector 20A do not reach the positions of the interference prevention parts 62 of the hook member 18A, but detachably interfere with the lower surface of the hook member 18A. Thus, even when the hook member 18A is subjected to the application of a force to pivot in a direction for making engagement by the vibration, oscillation or the like of the first buckle body 5, the suppression-specific projections 61 interfering with the lower surface of the hook member 18A prevent the hook member 18A from pivoting in a direction for making engagement. As a result, the engagement between the engagement hole 14B and the hook part 39A can be reliably avoided to thereby prevent incorrect wearing.

Figure 12:
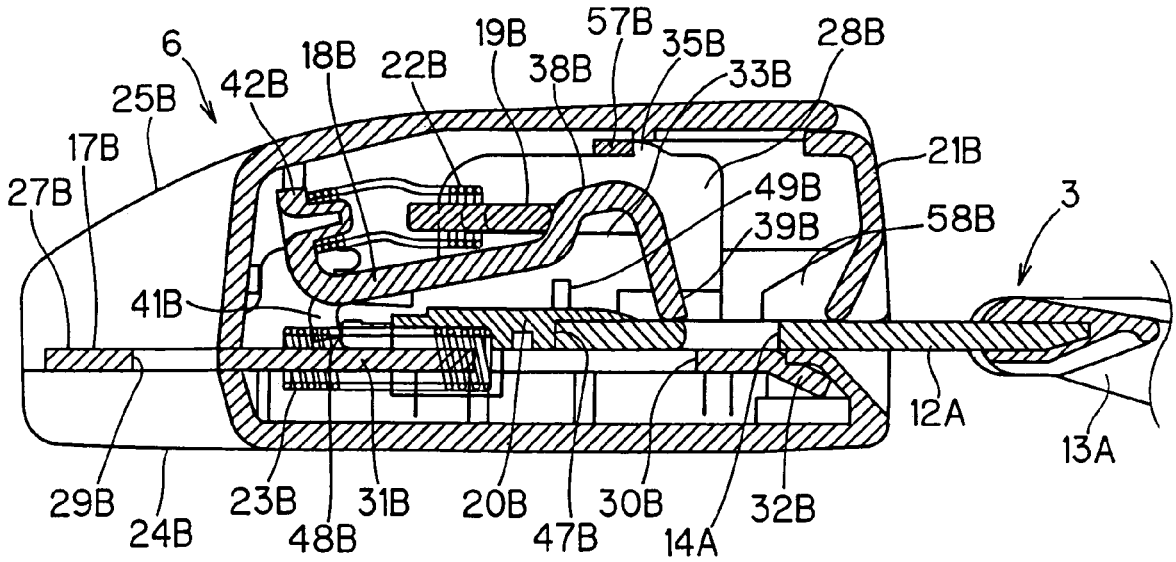
FIG. 12 is a sectional view showing the first tongue plate inserted into the second buckle body.

On the other hand, it is assumed that the first tongue plate 3 is mistakenly inserted into the second buckle body 6. As shown in FIG. 12, the distance Q from the insertion front end to the insertion terminal end of the tongue part 12A of the first tongue plate 3 is longer than the corresponding distance R at the second tongue plate 4. Further, the distance M between the abutment part 47B and the pushing part 48B of the ejector 20B is longer than the corresponding distance L at the ejector 20A of the first buckle body 5. Thus the ejector 20B has already reached a position for forcing the hook member 18B to pivot when the tongue part 12A of the first tongue plate 3 is being inserted.

In this case, the distance N from the insertion front end to the engagement hole 14A of the tongue part 12A is longer than the corresponding distance P at the second tongue plate 4, and hence the engagement hole 14A does not reach a position for making engagement with the hook part 39B of the hook member 18B. For this reason, even when the pushing parts 48B of the ejector 20B push the to-be-operated parts 41B of the lock bar 19B to force the hook member 18B to pivot in a direction for making engagement, the lower surface of the hook part 39B touches the upper surface of the tongue part 12B to be prevented from pivoting. As a result, the engagement between the engagement hole 14A and the hook part 39B can be reliably avoided to thereby prevent incorrect wearing.

As discussed, when the tongue plates 3 and 4 are mistakenly inserted into the second buckle unit 2 and the first buckle unit 1, respectively, inadvertent engagement therebetween can be reliably avoided to thereby prevent incorrect wearing of the buckle units 1 and 2 without fail.

Further, the projection 60 projecting in a direction for releasing the tongue plate 3 is formed at the front edge of the tongue inlet 11A of the lower cover 24A at the first buckle body 5. This makes the distance S in a direction for releasing the tongue plate 3 at the tongue inlet 11A longer than the distance T in a direction for releasing the tongue plate 4 at the tongue inlet 11B of the lower cover 24B. Thus, the amount of insertion of the tongue part 12B of the second tongue plate 4 into the tongue inlet 11A can be effectively restricted. The movement of the ejector 20A is more effectively limited accordingly to prevent the ejector 20A from reaching a position for making engagement between the first tongue plate 3 and the hook member 18A, thereby more reliably preventing the pivotal movement of the hook member 18A in a direction for making engagement. That is, the projection 60 also constitutes restriction means for preventing the ejector 20A from reaching a position for making engagement when the second tongue plate 4 is mistakenly inserted.

The distance Q from the insertion front end to the insertion terminal end of the tongue part 12A at the first tongue plate 3 is set longer than the corresponding distance R at the second tongue plate 4. Thus the second tongue plate 4 is inserted less than the first tongue plate 3 when the second tongue plate 4 is inserted into the first buckle body 5. As a result, the movement of the ejector 20A can be more reliably restricted to thereby more securely prevent the pivotal movement of the hook member 18A in a direction for making engagement.

In the embodiment described above, it is assumed that the first buckle unit 1 is for a center seat and the second buckle unit 2 is for side seats. Alternatively, the first buckle unit 1 may be used for side seats and the second buckle unit 2 may be used for a center seat. Further, the structures and the like of the tongue plates 3, 4 and the buckle bodies 5, 6 are not limited to those in the foregoing description of the embodiment. Various modifications may be made to each member to the extent that no deviation is made from the idea of the present invention.

The invention claimed is:

1. A seat belt system comprising:

a first buckle unit including a first tongue plate and a first buckle body; and a second buckle unit including a second tongue plate and a second buckle body, the first and second buckle bodies respectively including:

frames;

ejectors slidably mounted on the frames in a direction in which the tongue plates are inserted, while being biased in a direction in which the tongue plates are released;

hook members pivotally mounted on the frames, the hook members pivoting when the tongue plates are inserted to make engagement with engagement holes formed at the tongue plates; and release buttons for breaking engagement between the hook members, and the tongue plates, a distance from an insertion front end to the engagement hole of the first tongue plate being longer than a distance from an insertion front end to the engagement hole of the second tongue plate, the ejectors respectively including abutment parts pushed by the tongue plates when the tongue plates are inserted, the ejectors further respectively including pushing parts in contact with the hook members when the tongue plates are most deeply inserted to force the hook members to pivot in a direction for making engagement with the tongue plates, a distance from the abutment part to the pushing part of the ejector of the first buckle body being shorter than a distance from the abutment part to the pushing part of the ejector of the second buckle body;

restriction means for preventing the ejector of the first buckle body from reaching a position for making engagement when the second tongue plate is inserted into the first buckle body, and the ejector of the first buckle body including suppression-specific projections for preventing pivotal movement of the hook member in a direction for making engagement until the ejector reaches a position for making engagement between the first tongue plate and the hook member.

2. The seat belt system according to claim 1, wherein the first and second buckle bodies respectively include lower covers with openings through which the tongue plates are inserted, and upper covers coupled to the lower covers, and wherein a projection is defined at the opening of the lower cover of the first buckle body, the projection projecting further in a direction for releasing the tongue plate than at the opening of the lower cover of the second buckle body, thereby constituting the restriction means.

3. The seat belt system according to claim 1, wherein a distance from an insertion front end to an insertion terminal end of an insertion part of the first tongue plate to be inserted into the first buckle body is longer than a distance from an insertion front end to an insertion terminal end of an insertion part of the second tongue plate to be inserted into the second buckle body, thereby constituting the restriction means.

4. The seat belt system according to claim 2, wherein a distance from an insertion front end to an insertion terminal end of an insertion part of the first tongue plate to be inserted into the first buckle body is longer than a distance from an insertion front end to an insertion terminal end of an insertion part of the second tongue plate to be inserted into the second buckle body, thereby constituting the restriction means.

* * * * *